US005216943A

United States Patent [19]

Adler et al.

[11] Patent Number: 5,216,943

[45] Date of Patent: Jun. 8, 1993

[54] PISTON FOR HYDROSTATIC AXIAL AND RADIAL PISTON MACHINES AND METHOD FOR THE MANUFACTURE THEREOF

[75] Inventors: Bernhard Adler, Thalfingen; Jerzey Kreja, Nersingen, both of Fed. Rep. of Germany

[73] Assignee: Hydromatik GmbH, Elchingen, Fed. Rep. of Germany

[21] Appl. No.: 853,181

[22] Filed: Mar. 18, 1992

[30] Foreign Application Priority Data

Mar. 18, 1991 [DE] Fed. Rep. of Germany ..... 4108786

[51] Int. Cl.[5] ..... F01B 31/10

[52] U.S. Cl. ..... 92/157; 92/254; 29/888.042; 29/888.046; 29/888.047

[58] Field of Search ..... 91/488; 92/57, 66, 70, 92/71, 157, 172, 181 R, 248, 254, 261; 29/888.042, 888.044, 888.046, 888.047, 888.048

[56] References Cited

U.S. PATENT DOCUMENTS

| | | | |
|---|---|---|---|
| 3,080,854 | 3/1963 | Wiggermann | 92/172 |
| 4,494,448 | 1/1985 | Eystratov et al. | 92/172 |
| 5,007,332 | 4/1991 | Wagenseil | 92/181 R |
| 5,038,673 | 8/1991 | Schulze | 92/248 |

FOREIGN PATENT DOCUMENTS

| | | | |
|---|---|---|---|
| 1055879 | 4/1959 | Fed. Rep. of Germany . | |
| 3912213 | 10/1990 | Fed. Rep. of Germany . | |
| WO83/03650 | 10/1983 | PCT Int'l Appl. | 92/248 |
| 1525382 | 11/1989 | U.S.S.R. | 92/181 R |

OTHER PUBLICATIONS

Materials, Parts and Finishes, copyrighted 1984 by Technomic Publishing Co., pp. 378-379.

Goetzel, Cermets, vol. 7 of Metals Handbook, Ninth Edition, copyrighted 1984, American Society for Metals, pp. 798-800, 805-806.

*Primary Examiner*—Edward K. Look
*Assistant Examiner*—F. Daniel Lopez
*Attorney, Agent, or Firm*—Scully, Scott, Murphy & Presser

[57] ABSTRACT

A method of manufacturing a piston for hydrostatic axial and radial piston machines by non-machining forming, by filling a material that is in a substantially unresistant, formable state into a mold defining a piston outer contour which is closed on all sides, in which at least one supporting core is arranged spaced from the inner contour of the mold to remain in the completed piston to define a core region in the interior of the piston that is closed on all sides, then solidifying the material forming a piston with high strength characteristics and low weight, and removing the completed piston with the enclosed supporting core. The invention also comprises a piston for a hydrostatic axial or radial piston machine, made integrally of high-strength material in a non-machining forming process, such as by casting, sintering or the like, having in its interior at least one core region surrounded by the high-strength material and containing a supporting core that is provided to take up forces acting on the piston when in operation and which, during formation of the piston defines the core region, which supporting core is lighter than the high-strength material it replaces in the core region.

17 Claims, 4 Drawing Sheets

PISTON FOR HYDROSTATIC AXIAL AND RADIAL PISTON MACHINES AND METHOD FOR THE MANUFACTURE THEREOF

TECHNICAL FIELD OF THE INVENTION

The invention relates to pistons for hydrostatic axial and radial piston machines and to methods for the manufacture thereof.

BACKGROUND OF THE INVENTION AND PRIOR ART

In the prior art, pistons for axial and radial piston machines are known that have each a hollow piston chamber open at the base of the piston and filled with a filler piece that is less dense than the material of the piston. The weight saved in this way, in comparison to a solid piston, makes possible greater rates of revolution and thus greater power for the axial or radial piston machine concerned.

These known pistons are manufactured in a technically complicated and therefore very expensive manner by plastic forming, e.g. drop forging, with subsequent machining of the forged blank to form its outer contour, including the head part in the case of spherical head pistons and slipper pistons, and the hollow piston chamber provided for accommodating the filler piece.

With these known pistons it is important that the filler piece is securely held in place under all operating conditions to avoid damage thereof and thus premature breakdown of the piston. This secure fastening is sought through the use of complicated structural and production, and thus expense-increasing, measures.

A piston of this kind is known, for example, from DE-PS 37 32 648 in which annular grooves are turned into the jacket inner surface facing the hollow piston chamber on both sides of a plane containing the transverse center axis of the hollow piston chamber. The filler piece material that is cast into the hollow piston chamber in a liquid state shrinks in the radial and axial directions on cooling. In the axial direction it shrinks against the walls of the grooves and is tensioned against them. The cooled filler piece is thus held by the shrink-fit connection with the groove walls in the hollow piston chamber but exhibits radial clearance as a result of the shrinkage.

SUMMARY OF THE INVENTION

According to the one aspect of the present invention, there is provided a method for the manufacture of a piston for hydrostatic axial and radial piston machines by non-machining forming, comprising the following steps: filling a material that is in a substantially unresistant, formable state into a mold defining a piston outer contour which is closed on all sides, in which at least one supporting core is arranged spaced from the inner contour of the mold to remain in the completed piston to define a core region in the interior of the piston that is closed on all sides, densification of the material forming a piston with high strength characteristics and low weight, and removal of the completed piston with the enclosed supporting core.

According to another aspect of the present invention there is provided a piston for a hydrostatic axial or radial piston machine, made integrally of high-strength material in a non-machining forming process, such as by casting, sintering or the like, having in its interior at least one core region surrounded by the high-strength material and containing a supporting core that is provided to take up forces acting on the piston when in operation and which, during formation of the piston, defines the core region, which supporting core is lighter than the high-strength material it replaces in the core region.

The piston according to the invention is made integrally with the filler piece already contained therein, in a non-machining forming process without subsequent machining and thus in a considerably more economical manner than the conventional pistons. This is still the case if, for example, subsequent fine machining to increase the surface quality should be necessary. The forming processes available are various and through appropriate selection enable the required qualities such as stability and dimensional accuracy to be obtained, for which, for example, sintering and, in consideration of economy, die casting or centrifugal casting, are particularly suitable.

Instead of forming the filler piece by casting it into the piston according to the prior art, according to the invention the piston is formed around the filler piece and solidified against it, so that the filler piece is in shrink-fit connection with the piston without any radial clearance and in this way can be formed as a supporting core which, during operation, takes up forces acting on the piston. As a result it is possible, when using a supporting core that is lighter than the piston material it replaces in the core region, to reduce weight in comparison to the known piston, namely by increasing the radial dimensions of the core region or the supporting core and at the same time reducing the thickness of the piston jacket; preferably so that the volume of the core region is larger than about 50% of the associated piston volume. This effect is increased further by the use of a high-strength material for the piston. Furthermore the stability of the piston according to the invention already exceeds that of the known piston because it has one or more core regions enclosed on all sides by the piston material instead of the hollow piston chamber that is open on one side according to the state of the art.

The supporting cores used to form the core regions during the formation of the piston according to the invention replace the filler pieces of the known pistons and are, so to speak, automatically and absolutely securely fixed in the relevant core region because they are enclosed on all sides. The complicated structural and production measures known from the prior art for securing the filler piece in the hollow piston chamber are dispensed with. Because the supporting core or cores are located within the respective core region, the piston according to the invention does not have any seams through which pressurized oil could penetrate into the core regions and, if this were to happen by way of an oil bore, reduce the volumetric efficiency of the relevant axial piston machine.

The supporting cores are made of materials that not only take up forces occurring during the operation of the piston but which also remain substantially stable in form under the temperature and pressure conditions during the manufacture of the piston and thus, here too, perform a satisfactory supporting function, particularly when sintering. Surface melting or softening of the supporting cores can be considered unharmful.

The supporting cores are lighter than the piston material that they replace. They can either fill the respective core region completely or, when at least one hollow chamber is formed, in part. In the first case their density is less than that of the piston material; in the latter case this is not absolutely necessary particularly if each supporting core is formed as a hollow supporting core that contains the respective hollow chamber. To further increase the stability or reduce the weight a reinforcing body can be arranged in the hollow chamber of such a supporting core, either of solid form or, for example, as a laminated supporting construction.

As materials for the supporting cores and the reinforcing bodies metals and metal alloys, ceramic materials, sintered metals and the like can be considered, providing they fulfil the above-mentioned requirements in relation to their dimensional stability during piston manufacture, their strength as necessary during the operation of the piston and their density. Compound materials of two or more materials, such as glass, metal, ceramic materials, sintered metals, plastics material and the like may also be used. Particularly worth mentioning are composite fiber materials, preferably those with carbon fibers. The strength characteristics, in particular the modulus of compression, of the materials used for the supporting cores need not necessarily surpass those of the piston material.

One piston disclosed in DE-AS 1,055,879 has several hollow chambers in which hollow cores are arranged. However, this is an oil-cooled piston for diesel motors which is subjected to considerably lower temperatures and lesser demands in relation to bending and pressure than pistons for hydrostatic axial and radial piston machines, and which is not subject to centrifugal forces such as occur in radial piston machines. The hollow chambers, like the hollow cores, are not enclosed on all sides but are connected to oil supply passages. Together with the oil supply passages they represent an oil circulating system serving to cool the piston. The hollow cores consist only of thin-walled sheet metal and do not have any supporting function.

The core region or regions of the piston according to the invention preferably extend in the longitudinal direction of the piston, and may expediently be elongated. However, spherical core regions may also be used for example, that are combined in an elongated arrangement.

Expediently, each core region is arranged concentrically around the piston axis.

According to a further development of the invention the piston includes a piston section free from core regions which extends along the whole piston length at least in the region of the piston axis. In such a case, particularly for a cylindrical piston, at least one core region that is annular in cross-section, or two diametrically opposed core regions, each substantially semicircular in cross-section, can be used. The piston according to the invention may, however, also include at least one core region of a different shape, for example one having a circular cross-section. According to a further development of the invention the piston has an oil bore which extends substantially along the piston axis, i.e. through the piston section which is free of core regions or through a core region or supporting core. The bore is expediently defined by a core piece used during the formation of the piston and which may be tubular so that, in contrast to a solid core piece, it need not be removed from the piston to form the passage for the oil bore. In the case of a solid core piece it is advantageous to replace it by a tube after the formation of the piston, which tube then defines the oil bore. The core piece can be used during the formation of the piston to affix the supporting core within the mold.

BRIEF DESCRIPTION OF THE DRAWINGS

The invention will now be described in more detail with reference to several preferred exemplary embodiments shown in the drawings, in which.

DETAILED DESCRIPTION OF PREFERRED EMBODIMENTS OF THE INVENTION

Figure 1:
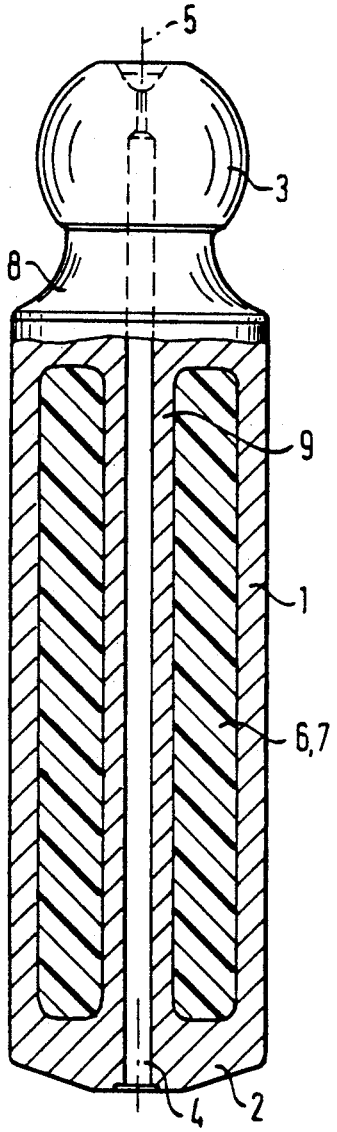
FIG. 1 shows a first exemplary embodiment of a piston according to the invention, partly in longitudinal section.

The pistons shown in the drawings comprise a high-strength steel alloy, are provided for a hydrostatic axial piston machine of the swashplate design, and include a cylindrical piston shaft 1 with a piston base 2 at its one end and a swivel head 3 at its other end that is formed to engage in a slipper that is supported in known manner against the swashplate of the axial piston machine. An oil bore 4 passes through the pistons shown in FIGS. 1 to 8 and 11 to 12 along the piston axis 5. It leads out in known manner at the piston base 2 and at the swivel head 3 and serves to supply oil to the slipper to provide a hydrostatic bearing there. The pistons shown in FIGS. 9, 10 and 13, 14 do not have an oil bore.

Figure 2:
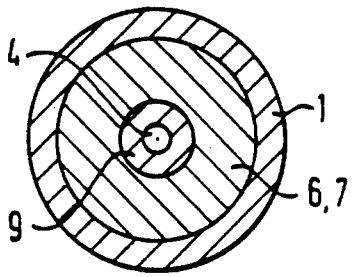
FIG. 2 shows an axial section of the piston shown in FIG. 1.

In the interior of the piston shown in FIGS. 1 and 2, in the region of the piston shaft 1, there is a core region 6, annular in cross-section, that is elongated in the longitudinal direction of the piston and formed in concentric arrangement with the piston axis 5 and is filled completely by a likewise annular supporting core 7 of a lighter material that takes up forces occurring during the operation of the piston, for example a compound material with high-strength carbon fibers, such as aramide fibers that are embedded in a duroplastic plastics material. The core region 6 and supporting core 7 are enclosed on all sides by the piston base 2, the piston shaft 1 and a part 8 connecting the shaft to the swivel head 3, and they surround a core-region-free piston section 9 through which the oil bore 4 runs. The cross-sectional area of the supporting core 7 is larger than 50% of the cross-sectional area of the piston in the region of the piston shaft 1, as it is also in the case of the following exemplary embodiments.

Figure 3:
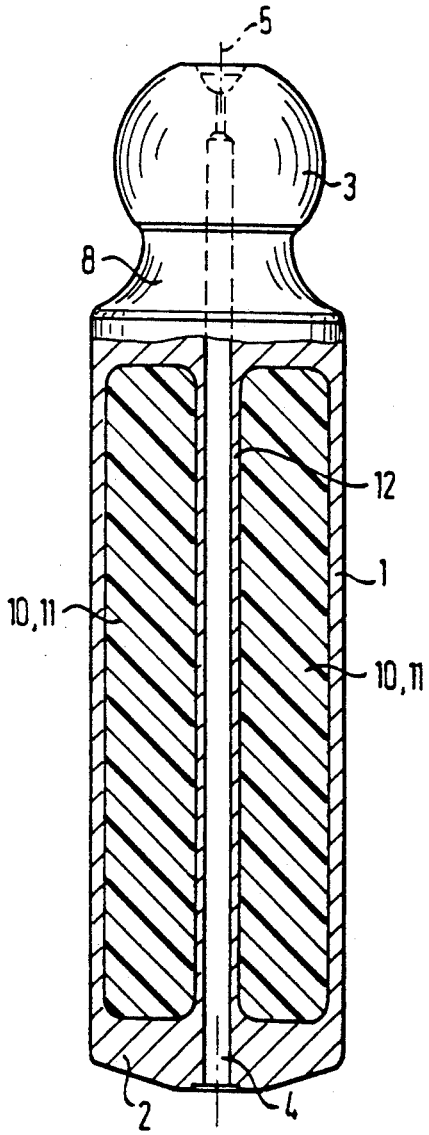
FIG. 3 shows a second exemplary embodiment of the piston according to the invention, partly in longitudinal section.
Figure 4:
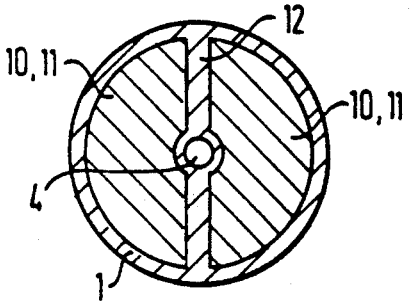
FIG. 4 shows an axial section of the piston shown in FIG. 3.

The piston shown in FIGS. 3 and 4 differs from that shown in FIGS. 1 and 2 only in the use of two substantially semicircular supporting cores 10 which completely fill two core regions 11 of corresponding shape. The two core regions 11 are separated from one another by a web 12 representing the core-region-free piston section. In the region of the piston axis 5 the web 12 is extended on both sides to provide sufficient material to accommodate the oil bore 4.

Figure 5:
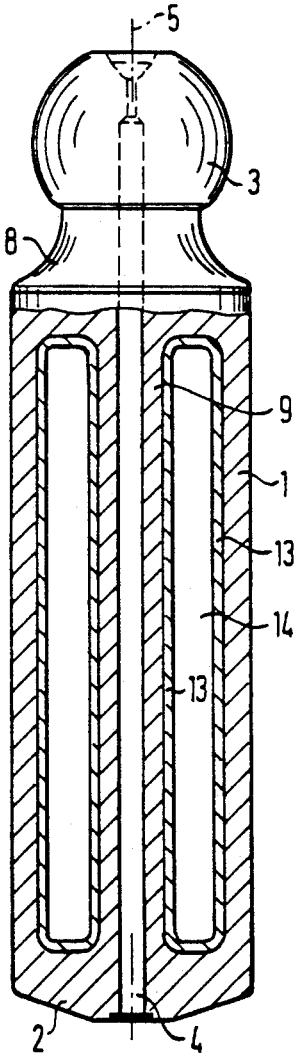
FIG. 5 shows a third exemplary embodiment of the piston according to the invention, partly in longitudinal section.
Figure 6:
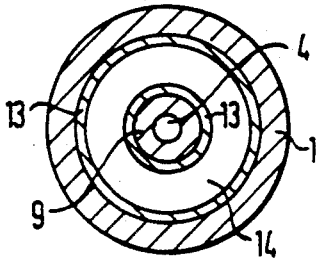
FIG. 6 shows an axial section of the piston shown in FIG. 5.

The piston shown in FIGS. 5 and 6 differs from that shown in FIGS. 1 and 2 only in that the annular supporting core is formed as a hollow supporting core 13 which fits closely against the surrounding piston material, has a hollow chamber 14 in its interior and consists of a sintered material.

Figure 7:
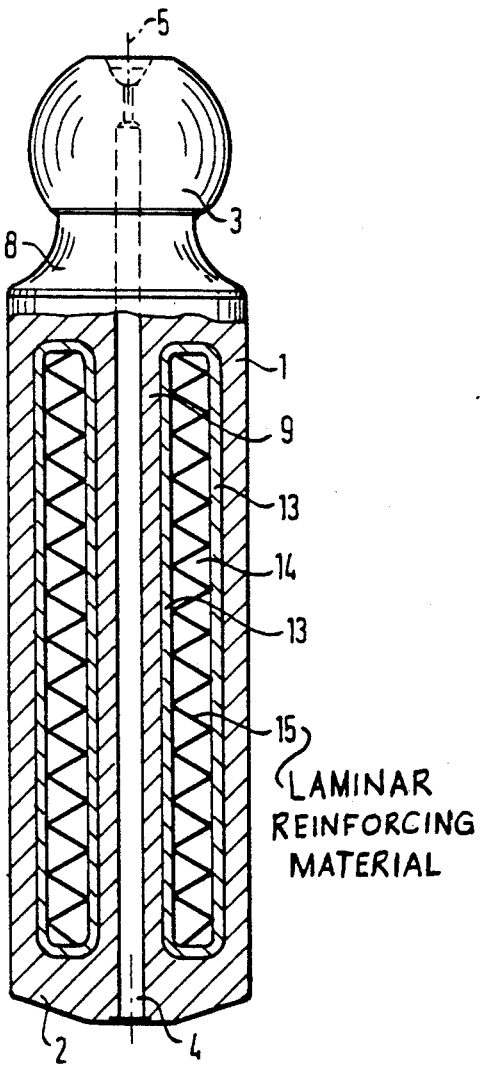
FIG. 7 shows a fourth exemplary embodiment of the piston according to the invention, partly in longitudinal section.
Figure 8:
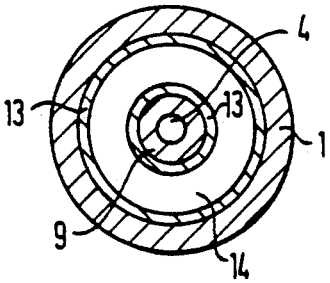
FIG. 8 shows an axial section of the piston shown in FIG. 7.

The piston shown in FIGS. 7 and 8 corresponds to the one shown in FIGS. 5 and 6 but has a laminar reinforcing construction 15 throughout the entire hollow chamber 14 of its annular hollow supporting core 13 which, as shown in FIG. 7, supports the radial inner and radial outer walls of the hollow supporting core 13 against one another in a zig-zag fashion.

Figure 9:
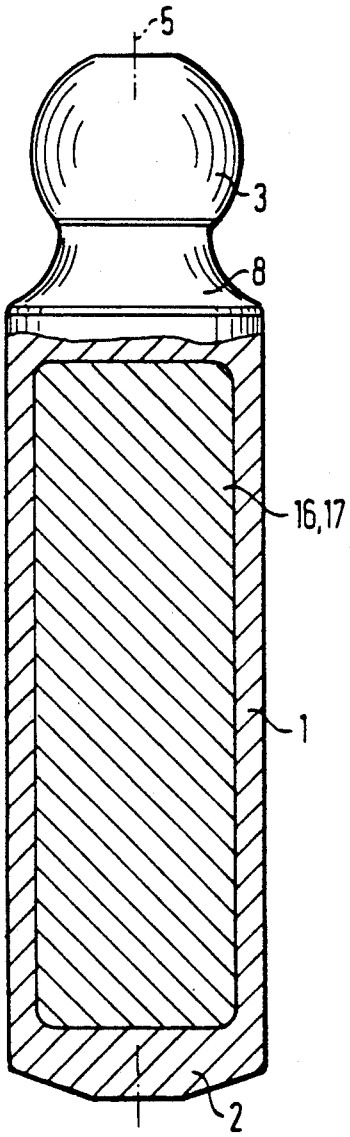
FIG. 9 shows a fifth exemplary embodiment of the piston according to the invention, partly in longitudinal section.
Figure 10:
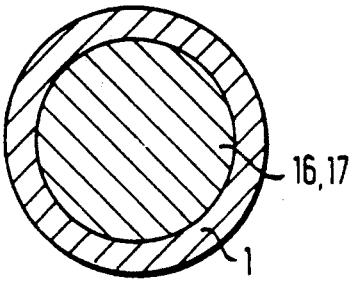
FIG. 10 shows an axial section of the piston shown in FIG. 9.

The piston shown in FIGS. 9 and 10 differs from that shown in FIGS. 1 and 2 in that it does not have an oil bore and is provided with a supporting core 16 of circular cross-section that is arranged in a core region 17 of the same shape, filling it completely.

Figure 11:
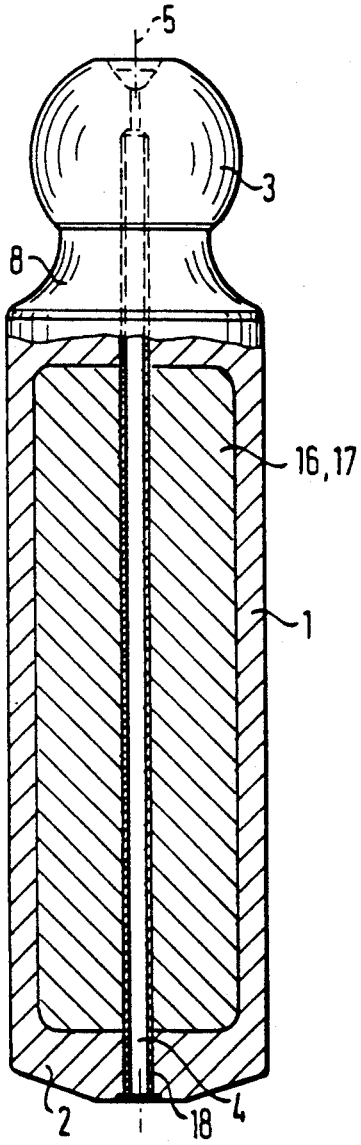
FIG. 11 shows a sixth exemplary embodiment of the piston according to the invention, partly in longitudinal section.
Figure 12:
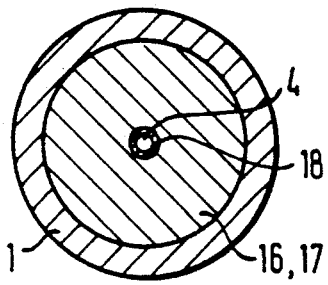
FIG. 12 shows an axial section of the piston shown in FIG. 11.

The piston shown in FIGS. 11 and 12 corresponds to the one shown in FIGS. 9 and 10 but is provided with an oil bore 4 which, due to the lack of a core-region-free piston section, extends in the region of the piston axis 5 within a tubular core piece 18 of light metal that passes through the piston base 2, the supporting core 16, the connected part 8 and the swivel head 3, as can be seen in FIG. 11.

Figure 13:
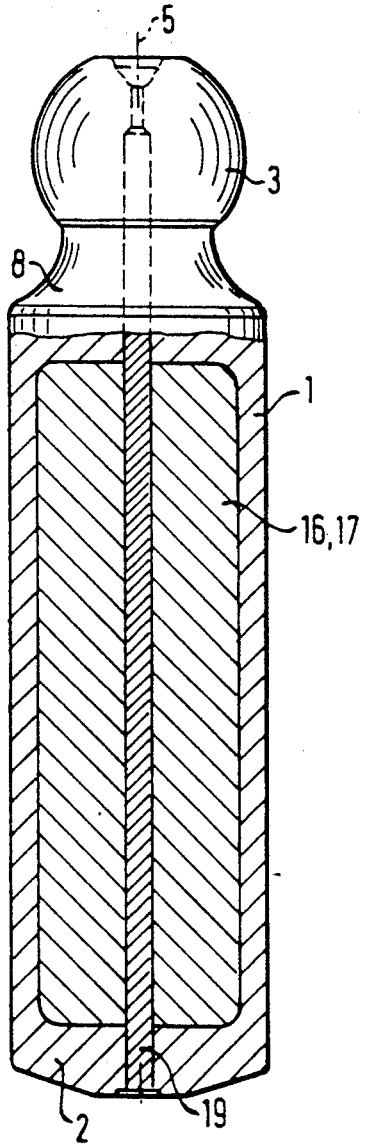
FIG. 13 shows a seventh exemplary embodiment of the piston according to the invention, partly in longitudinal section.
Figure 14:
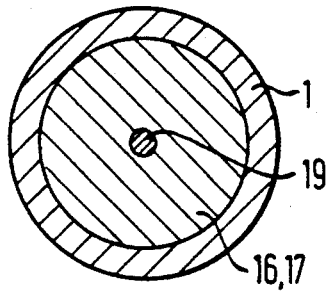
FIG. 14 shows an axial section of the piston shown in FIG. 13.

The piston shown in FIGS. 13 and 14 differs from that shown in FIGS. 11 and 12 only in that it has a cylindrical core piece 19 of an easily removable material which replaces the tubular core piece 18 defining the oil bore 4.

The pistons shown in the drawings are made integrally in a forming process without machining, e.g. by die casting. Referring by way of example to the piston shown in FIGS. 11 and 12, and briefly summarised, for this purpose the supporting core 16 is held by means of the tubular core piece 18 in a casting mold, spaced from the inner contour of the mold that determines the piston outer contour and is made of a material known in the art of die casting. Liquefied piston material is then injected under pressure in known manner into the space between the supporting core 16 and the casting mold. During cooling the piston material shrinks on all sides onto the supporting core 16 and forms therewith a piston/supporting core compound body of which both parts are joined together by a shrink fit. After sufficient cooling the casting form is opened and the completed piston removed. This is followed by short fine machining of the piston shaft 1 and the swivel head 3.

The pistons shown in FIGS. 1 to 8 and 13 and 14 are made in the same way, with the same casting mold as the piston shown in FIGS. 11 and 12, but using the respectively necessary supporting cores 7, 10 or 13 and the core piece 19 held coaxially between the annular supporting core 7, 13 or between the two semicircular supporting cores 10. By removing the core piece 19 an oil bore 4 results. In the case of the piston shown in FIGS. 13 and 14 the core piece 19 is not removed.

What is claimed is:

1. Method for the manufacture of a piston for hydrostatic axial and radial piston machines by non-machining forming, comprising the following steps: filling a material that is in a substantially unresistant, formable state into a mold defining a piston outer contour which is closed on all sides, in which at least one supporting core is arranged spaced from the inner contour of the mold to remain in the completed piston to define a core region in the interior of the piston that is closed on all sides, densification of the material forming a piston with high strength characteristics and low weight, and removal of the completed piston with the enclosed supporting core.

2. Method according to claim 1, wherein said material is in a doughy to liquid state, poured into the mold formed as a casting mold and then densified by cooling.

3. Method according to claim 2, wherein said material that is in a doughy to liquid state is charged into the casting mold under pressure.

4. Method according to claim 1, wherein said material is in powder form, poured into the mold formed as a sintering mold and densified by subsequent sintering under pressure and heating.

5. Piston for a hydrostatic axial or radial piston machine, made integrally of high-strength material in a non-machining forming process, having in its interior at least one core region surrounded by the high-strength material and containing a supporting core that is provided to take up forces acting on the piston when in operation and which, during formation of the piston defines the core region, which supporting core is lighter than the high-strength material it replaces in the core region; said supporting core at least partially filling the core region to form at least one hollow chamber therein; and a reinforcing element being arranged in the hollow chamber in the hollow supporting core.

6. Piston for a hydrostatic axial or radial piston machine, made integrally of high-strength material in a non-machining forming process, having in its interior at least one core region surrounded by the high-strength material and containing a supporting core that is provided to take up forces acting on the piston when in operation and which, during formation of the piston defines the core region, which supporting core is lighter than the high-strength material it replaces in the core region; and a core-region-free piston section extends over the entire length of the piston at least in the region of the piston axis.

7. Piston for a hydrostatic axial or radial piston machine, made integrally of high-strength material in a non-machining forming process, having in its interior at least one core region surrounded by the high-strength material and containing a supporting core that is provided to take up forces acting on the piston when in operation and which, during formation of the piston defines the core region, which supporting core is lighter than the high-strength material it replaces in the core region; and including two diametrically opposed of said core regions which are substantially semicircular in cross-section.

8. Piston according to claim 5, 6 or 7, wherein the volume of the core region is greater than about 50% of the associated piston volume.

9. Piston according to claim 5, wherein the supporting core fills the core region completely.

10. Piston according to claim 5, 6 or 7, wherein the core region extends in the longitudinal direction of the piston.

11. Piston according to claim 5, 6 or 7, wherein the core region is elongated.

12. Piston according to claim 5, 6 or 7, wherein the core region is arranged concentrically with the piston axis.

13. Piston according to claim 5, 6 or 7, which includes at least one core region that is annular in cross-section.

14. Piston according to claim 5 or 6, which includes at least one core region that is circular in cross-section.

15. Piston according to claim 5, 6 or 7, which includes an oil bore extending substantially along the piston axis.

16. Piston according to claim 15, wherein said oil bore is defined by a core piece used during the formation of the piston.

17. Piston according to claim 16, wherein said core piece is a tubular core piece.

* * * * *